United States Patent [19]

Kasuga

[11] 4,079,686

[45] Mar. 21, 1978

[54] INTERMITTENT DRIVE FOR A SEWING MACHINE

[75] Inventor: Noboru Kasuga, Hachioji, Japan

[73] Assignee: Janome Sewing Machine Co., Ltd., Tokyo, Japan

[21] Appl. No.: 769,798

[22] Filed: Feb. 17, 1977

[30] Foreign Application Priority Data

Feb. 20, 1976 Japan ..... 51-17011
Feb. 20, 1976 Japan ..... 51-17012

[51] Int. Cl.[2] ..... D05B 69/22
[52] U.S. Cl. ..... 112/274; 112/279
[58] Field of Search ..... 112/274, 271, 279, 220, 112/67, 87; 192/45, 56 L, 103 B

[56] References Cited

U.S. PATENT DOCUMENTS

| | | | |
|---|---|---|---|
| 2,969,755 | 1/1961 | Reece | 112/274 X |
| 3,058,437 | 10/1962 | Iida | 112/220 |
| 3,108,670 | 10/1963 | Habicht | 192/45 X |
| 3,221,850 | 12/1965 | Bacon | 192/45 |
| 3,253,685 | 5/1966 | Marola et al. | 112/275 |
| 3,908,568 | 9/1975 | Fugii | 112/274 |

*Primary Examiner*—H. Hampton Hunter
*Attorney, Agent, or Firm*—Striker, Striker & Stenby

[57] ABSTRACT

A sewing machine has a housing and a needle displaceable on the housing between a down position engaging through a workpiece and an up position disengaged therefrom. A drive is connected to a drive wheel rotatable on a drive shaft in the housing that in itself is operatively connected to the needle. A clutch including a clutch member on the shaft between the shaft and the wheel has a control element displaceable between an engaged position for rotationally coupling the wheel and the shaft and a disengaged position for free relative rotation of the wheel and the shaft. Thus in the engaged position of the clutch the drive can vertically reciprocate the needle between its up and down positions. A stopper member having an engaging part is mounted on the shaft and a stopper is mounted on the housing. The stopper is displaceable between an operative position engageable with the engaging part for stopping rotation of the shaft in a predetermined angular position corresponding to the up position of the needle and an inoperative position unengageable with the engaging part. A spring between the clutch member and the stopper member allows a relative angular movement thereof between a pair of angularly offset positions. Finally the control element can be displaced from the engaged to the disengaged position on engagement of the stopper in the operative position of the clutch with the engaging part of the stopper member so that the shaft can be arrested in the predetermined angular position corresponding to the needle up position and substantially simultaneously rotationally upcoupled from the wheel. A mechanism is provided for substantially simultaneously displacing the control element into the engaged position and the stopper into the inoperative position.

24 Claims, 13 Drawing Figures

INTERMITTENT DRIVE FOR A SEWING MACHINE

FIELD OF THE INVENTION

The present invention relates to a sewing machine. More particularly this invention concerns an arrangement for intermittent stitching in a sewing machine.

There is described in my copending application Ser. No. 668,565, filed Mar. 24, 1976, the disclosure of which is incorporated herein by reference, a sewing machine having a motor connected to a drive wheel which can be connected via a clutch to a drive shaft that vertically reciprocates a sewing-machine needle between an up position free of a workpiece being stitched and a down position engaging through a workpiece being stitched. A cam on the shaft and a stopper on the housing are displaceable between an operative position engageable with each other for stopping rotation of the shaft in a predetermined angular position corresponding to the up position of the needle, and an inoperative position unengageable with each other. A cam is provided for displacing the control element of the clutch from an engaged to a disengaged clutch position on engagement of the stopper in its operative position with the cam so that the shaft can be arrested in a predetermined angular position and is substantially simultaneously rotationally uncoupled from the wheel. Pawls engageable with the cam carried on the shaft serve to substantially and simultaneously displace the clutch control element into the engaged position and the stopper into the inoperative position for starting of the sewing machine again after one intermittent-drive cycle.

Such an arrangement allows the user to sew one stitch at a time. Each time the pedal of the foot control for the machine is depressed the needle will reciprocate vertically once from its up position to its down position and back into its up position. Such intermittent stitching is very useful for basting, attaching buttons, and the like.

The known intermittent-stitching devices in sewing machines have several disadvantages. First of all if the handwheel or flywheel is rotated while the machine is automatically stopped in the intermittent-stitching mode, damage can result to the drive mechanism. It has been suggested to provide various decoupling arrangements, however none of these have proven themselves efficient in use and of a long service life. Furthermore, another disadvantage of these machines is that they start and stop relatively abruptly in the intermittent-stitching mode, so that the mechanism of the machine is frequently damaged.

SUMMARY OF THE INVENTION

It is therefore an object of the present invention to advance principles set forth in my above-mentioned case and to provide an improved sewing machine.

Another object is to provide such a sewing machine wherein the handwheel can be operated even when the machine is automatically stopped in the intermittent-stitching mode.

Yet another object is to provide a sewing machine which starts and stops gently in the intermittent-stitching mode.

These objects are attained according to the present invention in a sewing machine of the above-described general type having a housing, a needle on the housing displaceable between a down position engaging through a workpiece and an up position disengaged therefrom, a drive shaft on the housing operatively connected with the needle, a drive wheel on this drive shaft rotatable relative to this drive shaft, and a clutch on the shaft between the shaft and the wheel. This clutch includes a clutch member on the shaft and a control element displaceable between an engaged position for rotationally coupling the wheel on the shaft and a disengaged position for free relative rotation of the wheel and the shaft. Drive means including an electrical motor connected via a belt or chain to the drive wheel serves to rotate this drive wheel and thereby vertically reciprocate the needle between its up and down positions in the engaged position of the clutch.

In accordance with this invention stop means is provided including a stopper member having an engaging part and mounted on the shaft, and a stopper on the housing. The stopper is displaceable between an operative position engageable with the engaging part for stopping rotation of the shaft in a predetermined angular position thereof corresponding to the up needle position, and an inoperative positon unengageable with the engaging part. A spring means is provided between the clutch member and the stopper member for relative angular movement thereof between a pair of angularly offset positions.

Finally, means is provided for displacing the control element of the clutch from the engaged to the disengaged position on engagement of the stopper in the operative position with the engaging part of the stopper member, so that the shaft can be arrested in this predetermined angular position and is substantially simultaneously rotationally uncoupled from the drive wheel. Means is also provided for substantially simultaneously displacing the control element into the engaged position and the stopper into the inoperative position so that the sewing machine can be started up again after an intermittent stitching operation.

With the machine according to the present invention, therefore, the stopping operation is carried out in a relatively gentle manner due to the spring connection between the clutch member and the stopper member. Thus the service life of the machine is increased considerably and the machine runs with a great deal less noise than a prior-art machine.

The clutch according to this invention is of the roller type and comprises a bushing rotationally fixed on the shaft at the wheel driven by the drive motor. A roller ball is displaceable by the control element of the clutch between a position wedged between the bushing and the wheel and therefore rotationally coupling the two and a loose position between these two elements in which they can rotate relative to each other.

Three separate cams are provided on the shaft. The first cam constitutes the stopper member and is integrally formed with a lobe constituting the engaging part engageable with the stopper. This first cam is limitedly rotatable relative to the wheel and the shaft and is coupled thereto via at least one screw passing through at least one respective arcuate hole in this first cam, the screw being threaded into the bushing described above. A bumper provided at the end of this hole greatly reduces shock and noise in the machine.

The second cam has a formation or lobe engageable with the stopper to displace it from the operative to the inoperative position. This cam is formed on its opposite face with a plurality of notches engageable with pawls carried on the wheel and effective when the wheel is stopped to drop into these notches and rotationally couple the wheel and the second cam. When thus coupled rotation of the wheel rotates the second cam and causes a projection thereon to push the stopper into the inoperative position, allowing the control element correspondingly to move into the engaged position and start the machine up again. When, however, the drive wheel is rotated at high speed these paths are centrifugally urged outwardly so that they cannot fall into the notches and so that the drive motor can continue to run without operating the sewing machine. Only when the drive motor is stopped will the pawls fall into place and set the machine up to go through another intermittent-stitching cycle.

In accordance with this invention a third cam is provided which is rotationally fixed on the first cam and has formations which can prevent the pawl or pawls from falling into the notches on the second cam. In this respect it is noted that the second cam is limitedly rotatable relative to the first and third cams between a first position in which the pawls can engage in the notches of the second cam and a second angularly offset position in which they cannot. Only in the disengaged position of the clutch and the stopped position of the wheel can the pawls engage in the notches in the second cam.

According to this invention the first cam constituting the stopper member is connected via a spring to the shaft so as to be limitedly angularly displaceable relative thereto. In addition it is connected via the other above-mentioned spring to the clutch member constituting the second cam. A third spring is connected between the second and third cams so as normally to urge them into a position wherein the pawls cannot fall into the notches.

Thus with the system according to the present invention it is possible for the operator to throw a motor switch to an intermittent-drive position in which each time the foot control is pressed the sewing-machine needle will reciprocate up and down once. At the end of each reciprocation, in the up position of the needle, this needle will stop even though the motor continues to rotate, since the clutch member between the needle-drive shaft and the motor-drive pulley is disengaged. The user must then release the foot control so that the pawls carried on the drive pulley and centrifugally driven outwardly by the rotation thereof can fall into the notches on the second cam and allow this cam to push the stopper into the inoperative position so that the needle can go up and down one more time. Thus it is possible for the sewing machine operator to baste while using both hands to position the workpiece, and after each vertical reciprocation of the sewing-machine needle this operator can displace the workpiece with both hands into any desired new position.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

SPECIFIC DESCRIPTION OF A PREFERRED EMBODIMENT

Figure 1:
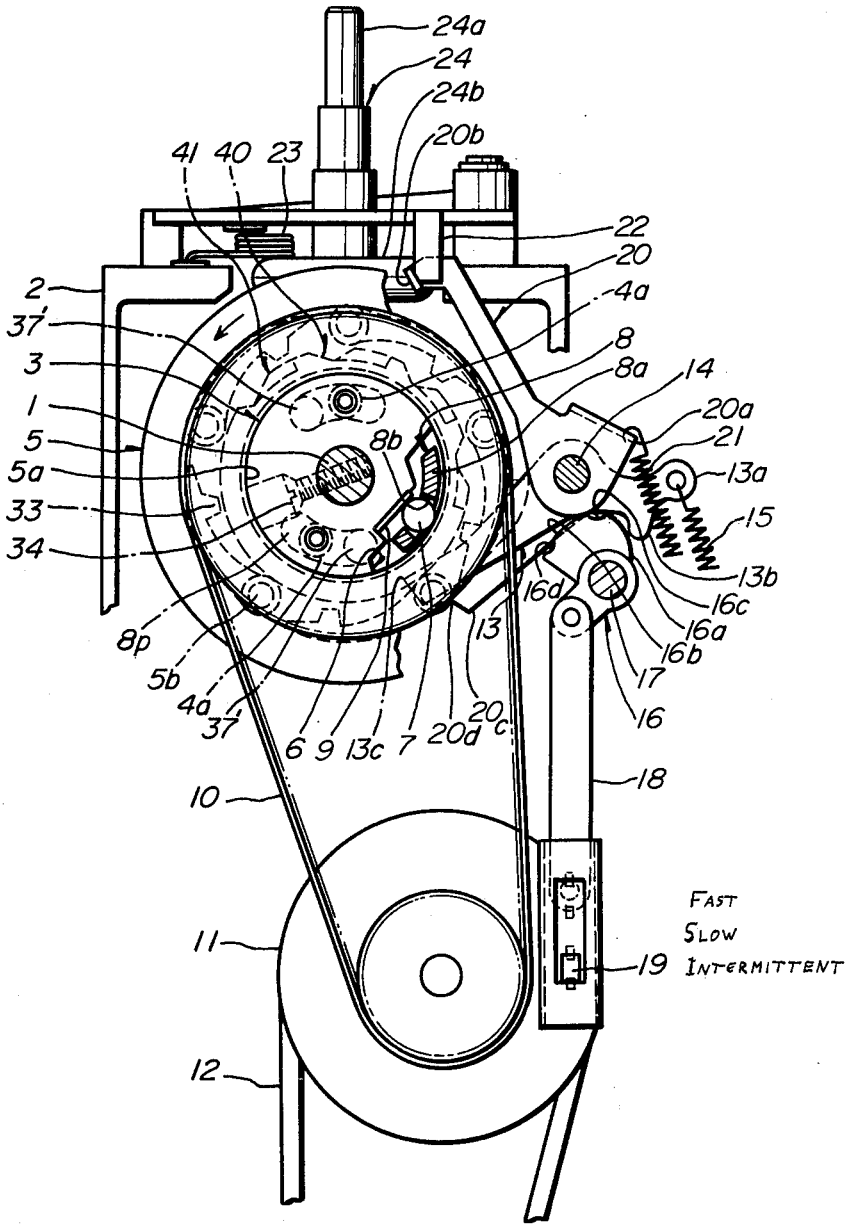
FIG. 1 is an end view partly in section through a portion of a sewing machine according to this invention.

As shown in FIG. 1 a main shaft 1 defines an axis A and is rotatably supported in a frame 2 of a sewing machine 103 (FIG. 12), and a bushing 3 is secured to the main shaft 1 at one end thereof by means of a screw 34. A belt wheel 5 is rotatable on the outer periphery of the bushing 3. A clutch mechanism 6 between the belt wheel 5 and the bushing 3 can interconnect the two and has a roller 7 held in a rectangular cutout **8*b* of an arm 8*a* of a clutch member 8. The roller 7 is brought by the arm 8*a* to a coupling position connecting the inner periphery 5*a* of the belt wheel 5 and a spacer 9 secured to the bushing 3 and to a decoupling position disconnecting the two members. When the roller 7 is moved in the counterclockwise direction in FIG. 1, the belt wheel 5 and the bushing 3 are engaged. When the roller is moved in the clockwise direction the belt wheel 5 and the bushing 3 are disengaged and the belt wheel 5 is rotatable relative to the bushing 3. The belt wheel 5 is rotated by a belt 10 which is wound around the belt wheel 5 and an intermediate pulley 11 which is rotated by another belt 12 wound around the intermediate pulley and a motor pulley (not shown). A stopper arm 13 is pivoted on a shaft 14 fixed to the machine frame 2 and has an end 13*a* which is biased by a spring 15 in the clockwise direction and a projection 13*b* engaged by a selecting cam 16 which is pivoted on a shaft 17 fixed to the machine frame 2, the cam 16 being operable for intermittent stitching. The selecting cam 16 is rotated by a link 18 which is at its upper end connected to the cam 16 at a pivot 17*a* and is vertically displaceable by an operating button 19. When the projection 13*b* of the stopper arm 13 is engaged by a low lobe 16*a* of the selecting cam 16 the stopper arm 13 is rotated in the clockwise direction to set the sewing machine for intermittent stitching. When the stopper arm 13 is engaged by a high lobe 16*b* of the cam 16 the stopper arm 13 is rotated in the counterclockwise direction and ordinary continuous stitching is selected. A double-armed lever 20 pivoted on the shaft 14 serves for winding thread and has one end 20*a* which is biased by a spring 21 in the clockwise direction, and an upper bent end 20*b* which is normally pressed against a depending arm 22 of a thread-winding device 24 by a spring 23. Therefore the thread winding device 24** is normally maintained in an inoperative position.

Figure 2:
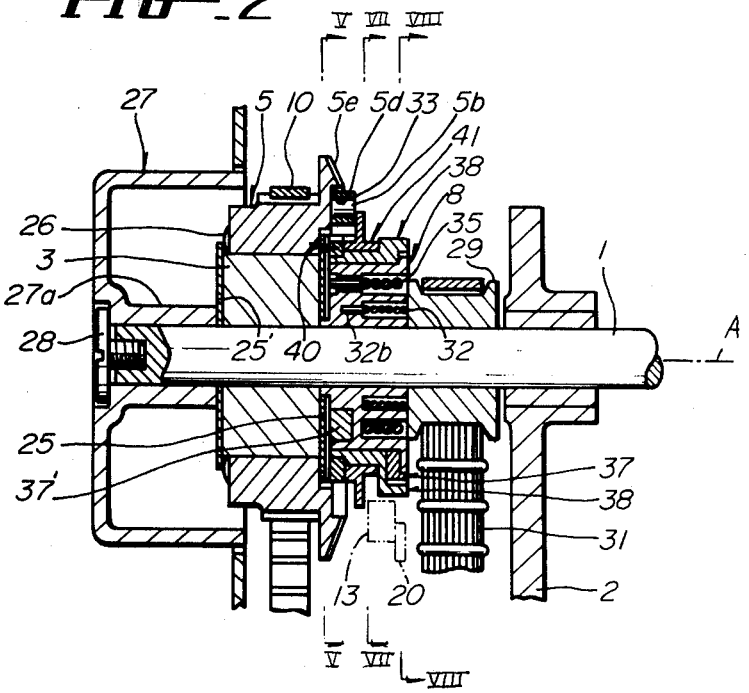
FIG. 2 is a longitudinal section through a portion of the mechanism shown in FIG. 1.
Figure 3:
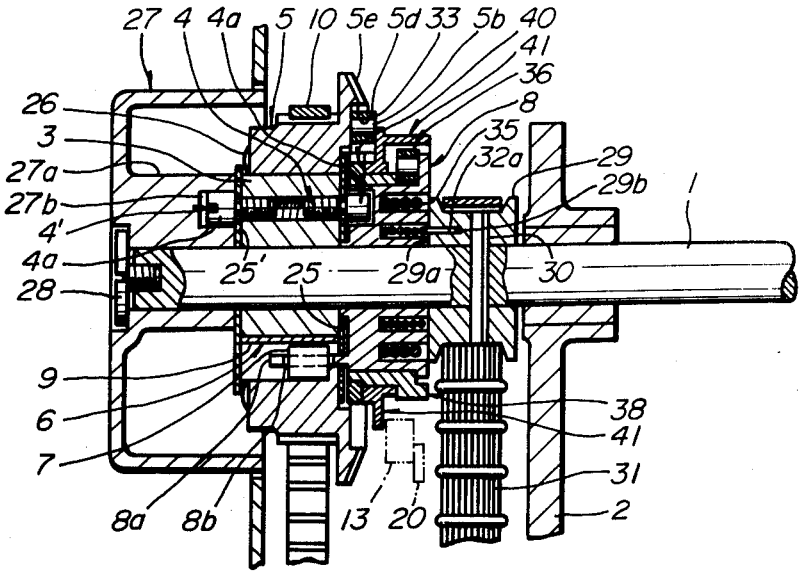
FIG. 3 is a section similar to FIG. 2 but with some of the parts rotated through 90°.

As seen in FIGS. 2 and 3 the belt wheel 5 is rotatable on the bushing 3 as aforementioned. The belt wheel 5 is on its right side in contact with a washer 25 secured to the bushing 3 by a pair of screws 4, only one of which is seen in FIG. 3. On the left side of the belt wheel 5 a washer 25' is secured to the bushing 3 by means of a pair of screws 4', only one of which is seen in FIG. 3. A spring washer 26 is mounted around the bushing 25' and the left side of the belt wheel 5 so that the belt wheel 5 is usually pressed axially against the washer 25 on the opposite side of the bushing 3. A flywheel 27 is mounted on one end of the main shaft 1 of the sewing machine as shown with a central boss 27*a* of the flywheel receiving the end part of the main shaft 1. Axial movement of the flywheel 27 is prevented by a screw 28. A bore 27*b* of the central boss 27*a* receives the head 4*a* of one of the screws 4'. Rotation of the flywheel 27 causes the main shaft 1 to rotate and thereby operate the associated parts of the sewing machine. A sprocket 29 is fixed to the main shaft so as to transmit its rotation to the lower fabric feed shaft (not shown) via a timing belt (31). The sprocket 29 is formed at one side 29*a* with a hole 29*b* where one end 32*a* of a torsion spring 32 is inserted to bias the clutch member 8 of the clutch mechanism 6 in the rotational direction of the main shaft 1.

As shown in FIGS. 1 to 5, the belt wheel 5 is furnished with five axially projecting and angularly equispaced pins 5*b* on its right side. Each of the pins 5*b* rotatably supports respective pawl 33. The back 33*a* of each pawl 33 contacts the inner wall 5*d* of a circumferential serrated flange 5*e* defining a central recess 5*c* on the belt wheel 5, and the outward turning movement of the pawls 33 is limited by the wall 5*d*. When the belt wheel 5 is rotated above a certain speed all of the pawls 33 are outwardly turned by centrifugal force and contact the inner wall 5*d* of the belt wheel 5. When the belt wheel 5 is stopped the pawls 33 which have then been positioned in the upper part of the belt wheel drop due to their own weight as shown in dotted lines in FIG. 5.

Figure 4:
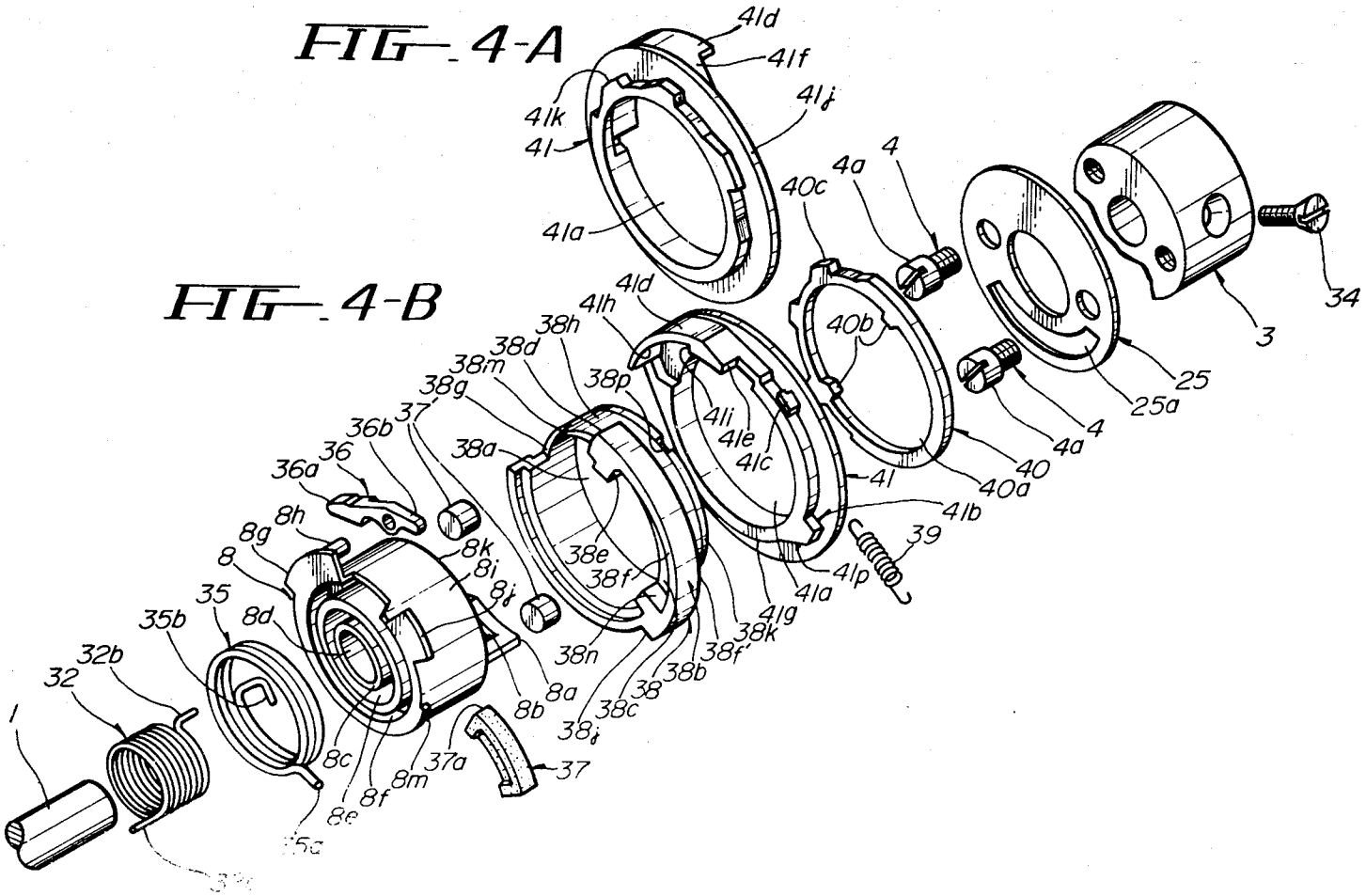
FIG. 4A is a perspective view of the stopper-releasing ring according to this invention.
FIG. 4B is an exploded perspective view of the basic mechanism according to this invention.
Figure 5:
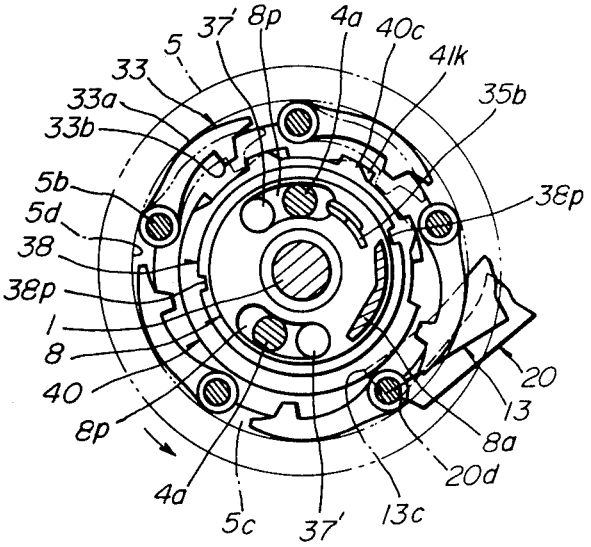
FIG. 5 is a section taken along line V—V of FIG. 2.

As shown in FIG. 4, the washer 25 is formed with an arcuate cutout 25*a* for permitting the arm 8*a* of the clutch member 8 to move therein. The clutch member 8 is formed as shown with a central boss 8*c* formed with a hole 8*d* for receiving the main shaft 1. The clutch member 8 is provided with an inner annular groove 8*e* in which a spring 32 is housed and an outer annular groove 8*f* into which another spring 35 is housed. The clutch member 8 is also provided with an outer cylindrical wall 8*i* which is formed with a flange 8*g* having a pin on which a small pawl 36 is pivotal. The pawl 36 is formed as shown and is heavier at its one end 36*a* than at its other end 36*b*. Therefore, when the clutch member 8 is rotated above a central speed, the end point 36*a* of the pawl 36 turned outwardly due to the greater centrifugal force effective thereon. When rotation speed of the clutch member 8 drops below a predetermined limit or when the clutch member 8 is stopped when the pawl 36 being positioned at the upper part of the main shaft 1, the end point 36*a* of the pawl 36 contacts the cylindrical wall 8*i* of the clutch member 8 and the other end 36*b* is spaced from this cylindrical wall 8*a*. Another flange 8*j* shaped as a circle segment is formed on the clutch member 8 and a buffer member or bumper 37 is mounted on the flange 8*j*. The rectangular hole 8*b* is formed in the arm 8*a*, and the aforementioned roller 7 is positioned in the hole 8*b*. The clutch member 8 is, as shown in FIG. 5, formed with a pair of curved oblong holes 8*p* opening axially at a rear end face 8*k* thereof, and each counterclockwise end of the holes 8*p* is furnished with a bumper or mass of buffer material 37'. The heads 4*a* of the screws 4 engage in the curved oblong holes 8*p* so that the clutch member 8 and the screws 4, i.e. the clutch member 8 and the main shaft 1 can move angularly relative to each other within a predetermined range.

Figure 7:
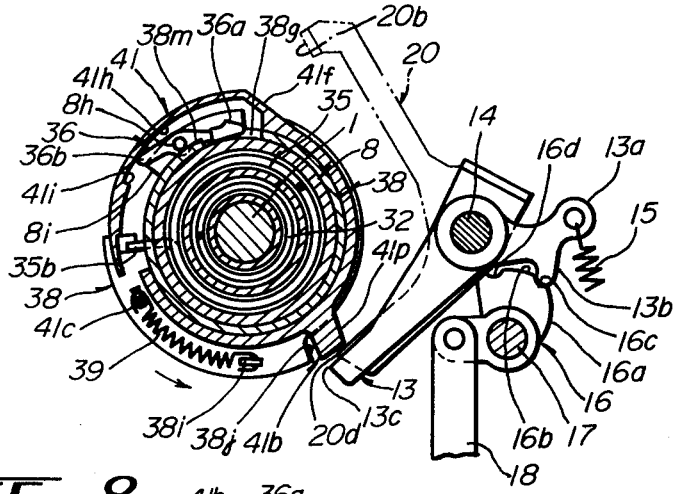
FIGS. 7 and 8 are sections taken along lines VII—VII and VIII—VIII of FIG. 2, respectively.
Figure 8:
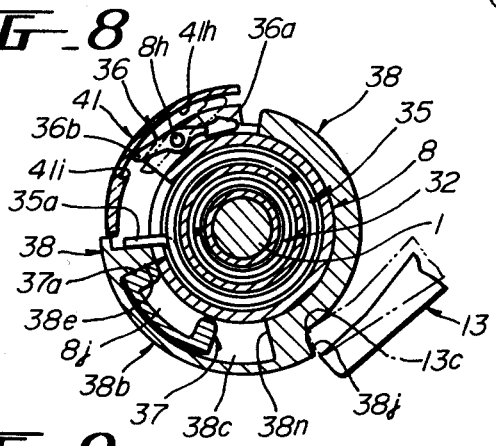

A stopper member or ring 38 has a central hole 38*a* snugly receiving the outer cylindrical part 8*i* of the clutch member 8. A segmental flange 38*j* of the stop member 38 is formed with a recess 38*c* in which the segmental flange 8*j* of the clutch member 8 is received together with the buffer member 37. One end 35*a* of a torsion spring 35 bears angularly against an end 38*d* of the flange 38*b*, and the other end 38*b* of the spring 35 is, as shown in FIG. 5, hooked on the clutch member 8. Therefore the end 37*a* of the buffer member 37 on the clutch member 8 is pressed against the end 38*e* of the segmented flange 38*b* with a torsional pressure of about 2.5 kg, strong enough to overcome the static torque of the sewing machine in the clockwise direction in FIG. 4B. Thus the clutch member 8 and the stop member 38 can move angularly relative to each other in a limited range. The side 38*f* of the flange 38*j* of the stop member 38 bears on a flange 8*m* of the clutch member 8 so that the axial position of the stop member 38 is determined. A radially open cutout 38*g* is formed in the cylindrical part 38*h* of the stop member 38. The end 36*a* of the small pawl 36 can drop into the cutout 38*g* and contact the outer cylindrical wall 8*a* of the clutch member 8 when the other end 36*b* of the pawl is spaced radially from the cylindrical wall 8*i* as shown in FIG. 7. On the side 38*f'* opposite the side 38*f* of the flange 38*b* of the stop member 38, there is provided a projection 38*i* over which one end of a relatively weak tension spring 39 is hooked. The engaging part 38*j* of the flange 38*b* of the stopper member 38 is engageable with the engaging end 13*c* of the stopper arm 13 to stop the rotation of the stopper member 38. The cylindrical wall 38*h* of the stopper member 38 is radially stepped to form a part 38*k* of a smaller diameter.

A pawl-releasing ring 40 with a central opening 40*a* is mounted on the part 38*k* of the stopper member 38. Projections 40*b* engage in the corresponding recesses 38*p* of the part 38*k* so that movement of the ring 40 around the stopper member 38 is prevented as shown in FIGS. 4B and 5. The pawl-releasing ring 40 is formed with three cam lobes 40*c* for pushing the pawls 33 radially outwardly.

Figure 6:
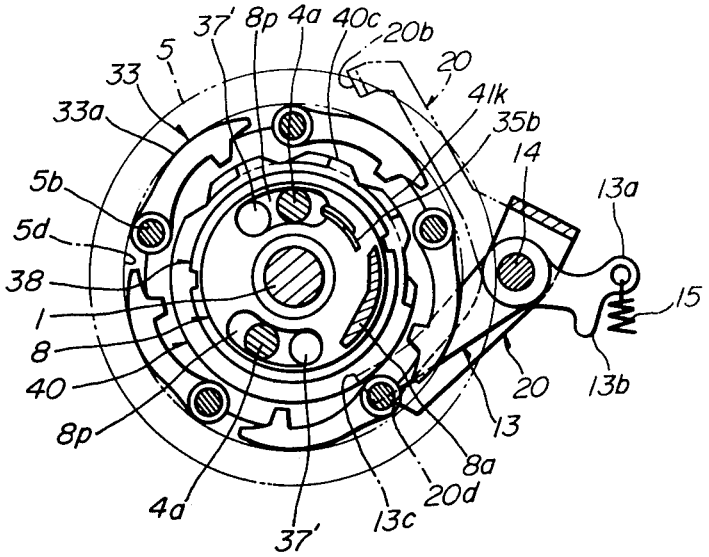
FIG. 6 is a section similar to FIG. 5 showing the mechanism of FIG. 5 in another position.

A stopper releasing ring 41 formed as shown in FIGS. 4A and 4B has a central opening 41*a* around the outer cylindrical wall 38*h* of the stopper member 38. A cam lobe 41*b* is formed on the stopper releasing ring 41 as shown. When the ring 41 is rotated on the stopper member 38, the cam 41*b* engages the stopper arm 13 to turn same radially outwardly as shown in FIG. 7. The stopper releasing ring 41 has a projection 41*c* over which is hooked the other end of the spring 39 whose one end of the spring 39 is hooked over the projection 38*i* of the stopper member 38. This spring 39 is of very weak strength so as to press the stopper releasing ring 41 with respect to the stopper member 38 in the rotational direction of the main shaft 1, so that in the ordinary state the end 41*e* of the arcuate flange 41*d* of the ring 41 is pressed lightly against the end 38*d* of the flange 38*b* of the stopper member 38. The arcuate flange 41*d* blends into the central collar 41*g* of the ring 41 via slanted part 41*f*. The flange 41*d* is formed with a step 41*i* on the inner face thereof as shown. Manual rotation of the flywheel 27 when the sewing machine automatically stops during intermittent stitching causes the end 36*b* of the pawl 36 to engage the step 41*i* to rotate the stopper releasing ring 41. As shown in FIG. 4A, on the opposite side of the stopper releasing ring 41, three engaging formations 41*k* are provided around the central opening 41*a*. When the sewing machine stops after one rotation of the main shaft 1 during intermittent stitching, and when the sewing machine is rotated again, one of the pawls 33 engages one of the engaging parts 41*k*, and the ring 41 is rotated to release the stopper arm 13 from an engaging part 38*j* of the stopping member 38. While the stopper arm 13 is released, the pawls 33 can not engage the engaging part 41*k* since the engaging parts 41*k* of the ring 41 and the cams 40*c* of the ring 40 are alternately displaced or staggered so as to cover the engaging faces of the engaging parts as shown in FIG. 6.

Figure 12:
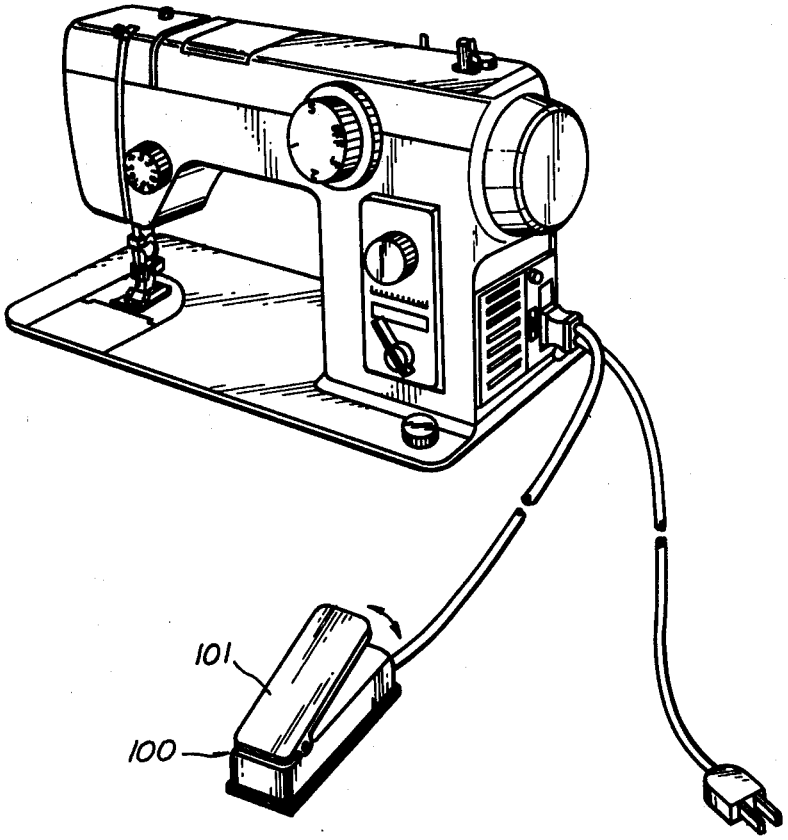
FIG. 12 is a perspective view of a sewing machine in accordance with this invention.

For ordinary continuous stitching the machine functions as follows: As shown in FIG. 1 when the intermittent stitching selecting button 19 is moved upwardly, the link 18 is raised accordingly, and the intermittent stitch selecting cam 16 is rotated in the clockwise direction so that the projection 13*b* of the stopper arm 13 engages the recess 16*c* or 16*d*, and the stopper arm 13 is turned in the counterclockwise direction. Thus, the end point 13*c* is moved out of the path or orbit of the engaging portion 38*j* of the stopping member 38 and of the cam 40*c* of the pawl-releasing ring 40. Therefore, when the pedal 101 of the foot controller 100 in FIG. 12 is depressed, the machine motor is driven to rotate the belt wheel 5. The rotational movement of the belt wheel 5 is transmitted to the bushing 3 by the roller 7 of the one-way clutch mechanism 6 which is now positioned in engagement with the belt wheel 5 and the spacer 9 of the clutch mechanism 6. Thus the main shaft 1 is continuously rotated and, therefore, the ordinary continuous stitches are produced by the vertically reciprocating needle 102.

During such operation the clutch member 8, stopping member 38, pawl-releasing ring 40 and stopper releasing ring 41 are united by the springs 35 and 39, and these members are biased by the spring 32 in the rotational direction of the main shaft 1 of the sewing machine. Therefore the roller 7 positioned in the cutout 8*b* of the arm 8*a* of the clutch member 8 is shifted into the coupling position in the counterclockwise direction in FIG. 1 where the roller 7 interconnects the belt wheel 5 and the bushing 3. The spring 32 is as aforementioned positioned in the annular groove 8*e* of the clutch member 8, and one end 32*a* of the spring is held in the blind axial hole 29*b* of the sprocket 29 as shown in FIG. 3 and the other end 32*b* is held in a blind hole provided in the rear side wall 8*k* of the clutch member 8 as shown in FIG. 2. The pawls 33 are, during rotation of the sewing machine, out of the orbits of the cams 40*c* of the pawl-releasing ring 40 and of the engaging parts 41*k* of the stopper releasing ring 41 due to the centrifugal force created by rotation of the belt wheel 5. When the rotation of the wheel 5 becomes very slow or stops, the pawl 33 positions at the upper part of the rings 40 and 41 drops and contacts the cam 40*c* and the engaging part 41*k* as shown with the dotted line in FIG. 5, but in this instance since the cams 40*c* and the engaging parts 41*k* are alternately positioned the uppermost pawl 33 cannot engage the engaging part 41*k* as shown in FIG. 6. In FIG. 1, the projection 13*b* of the stopper arm 13 sets the sewing machine to sew in a high speed when it is engaged by the recess 16*c* of the cam 16, and sets the sewing machine to sew in a lower speed when it is engaged by the recess 16*d* of the cam 16.

Operation for intermittent stitching is as follows:

When the intermittent stitch selector 19 is first moved downwardly to the position shown in FIG. 1, the intermittent stitch selecting cam 16 is rotated in the counterclockwise direction and the projection 13*b* of the stopper arm 13 is engaged by the part 16*a*. Therefore the stopper arm 13 is turned by the spring 15 in the clockwise direction, and the end point 13*c* of the stopper arm 13 enters the path of the engaging part 38*j* of the stopping member 38 and of the cam lobe 41*b* of the stopper releasing ring 41. When the pedal 101 of the foot controller 100 is depressed and the sewing machine runs the clutch member 8 is then rotated by the sprocket 29 via the spring 32, and the stopping member 38 and the pawl-releasing ring 40 are rotated via the spring 35 and the stopper releasing ring 41 is rotated via the spring 39.

Figure 9:
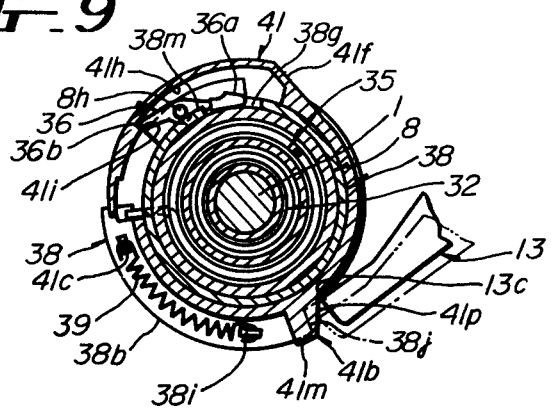
FIG. 9 is a view similar to FIG. 7 showing the mechanism of FIG. 7 in another position.
Figure 10:
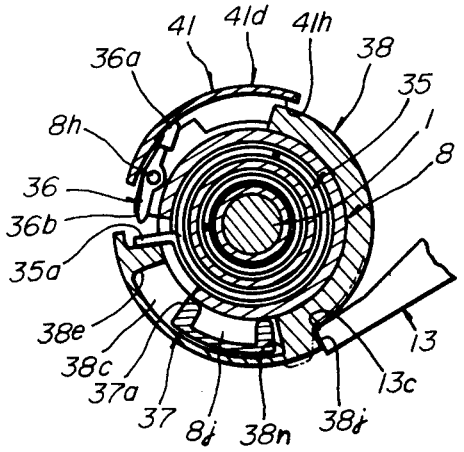
FIGS. 10 and 11 are views similar to FIG. 8 showing the mechanism thereof in two further positions.

Thus, as shown in FIG. 9, the slanted face 41*p* of the cam 41*b* of the stopper releasing ring 41 reaches the end 13*c* of the stopper 13. The spring 39 is so weak that the end point 13*c* of the stopper 13 stops the ring 41 from rotating. Since the clutch member 8 still rotates and since the tight end 36*b* of the pawl 36 is displaced toward the center of the main shaft 1 by centrifugal force, the step 41*i* of the arcuate flange 41*d* of the stopper releasing ring 41 is not engaged by the end 36*b* of the pawl 36. Therefore, while the stopper releasing ring 41 is held by the stopper arm 13, the stopping member 38 continues to rotate and the engaging part 38*j* comes, as shown in FIG. 10, to the position of the cam 41, and engages the end point 13*c* of the stopper arm 13. Thus the stopper member 38 is blocked by the stopper arm 13. The thereby produced relative movement of the stopper releasing ring 41 and the stoping member 38 stretches the spring 39, and therefore the engaging parts 41*k* of the stopper releasing ring 41 and the cams 40*c* of the pawl releasing ring 40 are relatively displaced from the position of FIG. 6 to the position of FIG. 5. Thus the engaging parts 41*k* and the cams 40*c* are in alignment, and one of the pawls 33 on the belt wheel 5 can drop into a valley between two engaging parts 41*k* to engage one of the engaging parts 41*k* when the belt wheel 5 is stopped.

In this manner, the stopping member 38 is arrested and the clutch member 8 which is under the influence of the braking force of the spring 35, subsequently comes to a standstill. Simultaneously the heavier end 36*a* of the pawl 36 on the clutch member 8 moves downwardly and radially inwardly and contacts the outer cylindrical wall 8*i* of the clutch member 8 and the other end 36*b* is raised. However, the main shaft 1 has considerable inertial torque and continues to rotate. Therefore the bushing 3 rotates relative to the clutch member 8 in the counterclockwise direction in FIG. 1, and the roller 7, which is located in the rectangular hole of the arm 8*a* of the clutch member 8, is moved to a wider space between the bushing 3 and the belt wheel 5. Thus the bushing 3 and the main shaft 1 are disconnected from the belt wheel 5.

In the meantime since the sprocket 29 is still rotating the spring 32 is twisted and strained in the rotational direction of the main shaft 1. The main shaft 1 continues to rotate due to its inertia. The heads 4*a* of the screws 4 fixed to the bushing 3 are, therefore, moved in the counterclockwise direction within the oblong holes 8*p* of the clutch member 8 as shown in FIGS. 1 and 5, and contact the respective bumpers 37'. Thus the rotational speed of the main shaft 1 is reduced in a first stage.

Meanwhile the clutch member 8 is rotated a little in the counterclockwise direction against the action of the spring 35. In this instance, the end point 36*a* of the pawl 36 on the clutch member 8 is raised by the slanted face 38*m* of the cutout 38*g* of the stopper member 38, and the end 36*b* is lowered accordingly. The end 36*b* of the pawl 36, therefore, does not engage the step 41*i* of the pawl releasing ring 41. Therefore the clutch member 8 can move relative to the stopper member 38 until the bumper 37 of the clutch member 8 located within the recess 38*c* of the arcuate flange 38*b* of the stopping member 38 contacts an end 38*n* of the recess 38*c*. In the meantime the rotation speed of the main shaft 1 is further reduced in a second stage by the action the spring 35 and further reduced in a third stage by the buffer material 37 contacting the end 38*n* of the recess 38*c*. Thus, the main shaft 1 of the sewing machine is stopped silently without shocks or impacts. The spring 35 is stressed to an extent proportional to the angular offset between the clutch member 8 and the stopper member 38. Since as mentioned above the torque exerted by this spring 35 is stronger than the static torque of the sewing machine, the spring 35 reverse rotates the clutch member 8 in the clockwise direction, and the main shaft 1 is reverse rotated until the end 37*a* of the buffer material 37 of the clutch member 8 contacts the end 38*e* of the recess 38*c* of the stopping member 38. Thus, the sewing machine is completely stopped. Accordingly, the stopped angular position of the main shaft 1 can be determined to correspond to the upper dead point of the needle 107 at the predetermined up position after one rotation of the main shaft.

If the spring 35 is designed to tighten around the boss between the circular grooves 8*e* and 8*f* of the clutch member 8 when the clutch member 8 is rotated relative to the stopping member 38 on stopping of the sewing machine, the spring 35 could produce the same buffer effect and the buffer material 37 could be omitted. As long as the pedal 101 of the foot controller 100 is depressed, only the belt wheel 5 is rotated. When the pedal of the controller is released, the belt wheel 5 stops and that one of the five pawls 33 on the belt wheel 5 which have been positioned in the upper part drops to the valley between the two engaging parts 41*k* of the stopper releasing ring 41, and is ready to engage one of the engaging parts 41*k*.

Figure 11:
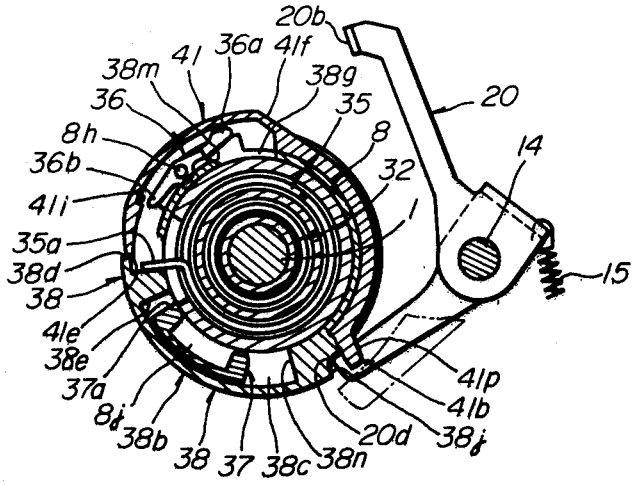

When the pedal 101 of the controller 100 is depressed again to drive the machine motor, the belt wheel 5 is rotated and the uppermost pawl 33 engages the engaging part 41*k* of the stopper releasing ring 41 as shown with the dot-dash line in FIG. 5 and rotates the ring 41 in the counterclockwise direction. Then as shown in FIG. 11 the slanted face 41*p* the cam 41*b* of the cam 41*b* of the stopper releasing ring 41 pushes the end point 13*c* of the stopper arm 13 outwardly and releases the stopper arm 13 from the stopper member 38. Subsequently the projection 33*b* of the pawl 33 rides up on the cam 40*c* to come to the top of the cam 40*c* of the pawl releasing ring so that the projection 33*b* is released from the engaging part 41*k*, and the pawl 33, together with the other pawls, turns radially outwardly by the centrifugal force as the belt wheel 5 is further rotated. Concurrently, the stopper releasing ring 41 is returned to the initial positon by tension of the spring 39. On the other hand, the stopping member 38, which has been released from the end 13*c* of the stopper 13 is rotated in the counterclockwise direction via the spring 35 by the counterclockwise rotation of the clutch member 8 due to the energy which has been stored in the spring 32. Therefore the end point 13*c* of the stopper arm 13 contacts the outer circumference of the flange 38*b* of the stopping member 38. Simultaneously the arm 8*a* of the clutch member 8 is shifted in the counterclockwise direction relative to the bushing 3 which has been stopped, and the roller 7 is pushed into the narrower space between the belt wheel 5 and the bushing 3. Thus the belt wheel 5 and the bushing are connected and the main shaft 1 is rotated. Accordingly the clutch member 8 is rotated by the sprocket 29 via the spring 32, the stopping member 38 via the spring 35 and the stopper releasing ring 41 via the spring 39. The end point 13*c* of the stopper arm 13 slides along the outer circumferences of the flange 38*b* of the stopper member 38 and the arcuate flange 41*d* of the ring 41 and decends along the slant face 41*f* to the part 41*g*, and again engages the face 41*p* of the cam 41*b* of the ring 41. Thus the main shaft of the sewing machine is stopped in the manner described above at a predetermined angular position. By alternately depressing and releasing the pedal 101 of the controller 100, the sewing machine is intermittently driven. Namely the main shaft 1 of the sewing machine is stopped at a predetermined angular position after one complete rotation, and intermittent stitching becomes possible.

A further explanation will be made concerning a safety device of this invention. Namely the flywheel of the sewing machine can be manually rotated in the normal directon while the sewing machine is stopped after the sewing machine has been intmittently driven. After the sewing machine has been intermittently driven, the end point 13*c* of the stopper arm 13 engages the engaging portion 38*j* of the stopping member 38 and the cam 41*b* of the ring 41. If the flywheel 27 has been reverse rotated a little in the clockwise direction in FIG. 1, the stopping member 38 is rotated in the same direction via the main shaft 1, sprocket 29, spring 32, clutch member 8 and spring 35. But the cam 41*b* of the stopper releasing ring 41 still contacts the end portion 13*c* of the stopper arm 13, since the spring 39 has been compressed between the ring 41 and the stopper member 38. The engaging portion 38*j* of the stopping member 38 would be displaced from the cam 41*b* of the ring 41 as shown in FIG. 7 were it not for the condition of the stopper member 13.

In this position the heavier end 36*a* of the pawl 36 drops to the cylinder face 8*i* of the clutch member 8, and the light end 36*b* of the pawl 36 is brought up and contacts the inner face 41*h* of the arcuated flange of the ring 41. In view of such a condition, when the flywheel 27 is rotated in the normal direction, the end 36*b* of the pawl 36 engages the stepped portion 41*i* formed in the inner face 41*h* of the arcuate flange of the ring 41 and rotates the ring 41 in the counterclockwise direction as illustrated in FIG. 9. Therefore, the end 13 is cammed outwardly by the slanted face 41*p* of the cam 41*b* of the ring 41 until the end 13*c* of the stopper arm 13 engages the top face 41*m* of the cam 41*b*. Thus the end 13*c* of the stopper arm 13 is displaced out of the orbit of the engaging portion 38*j* of the stopping member 38 and slides on the outer periphery of the segment flange 38*b* of the stopper member 38. Therefore, even when the sewing machine makes one complete rotation and the cam 41*b* of the ring 41 is again engaged by the end point 13*c* of the stopper 13, the slanted part 41*p* of the cam 41*b* displaces the stopper arm 13 in the outward direction again as the flywheel is continuously rotated. In this manner, the flywheel 27 can be rotated any number of times. After the manual operation of the flywheel, intermittent stitching can be carried out by operation of the machine controller as aforementioned, since the end 36*b* of the pawl 36 is not engaged to the step 41*i* due to the centrifugal force applied to the pawl.

The operation of the bobbin winding device 24 in accordance to this invention will be explained. As the sewing machine is switched over from ordinary continuous stitching to bobbin winding the stopper arm 13 is turned in the counterclockwise direction and is out of the rotation orbit of the engaging part 38*j* of the stopper member 38 as shown in FIG. 1. When the spool pin 24*a* is moved to press the rubber wheel 24*b* to the serrated flange 5*e* of the belt wheel 5, the depending arm 22 is moved to the right in FIG. 1. Therefore the upper bent end 20*b* of the double armed lever 20 is released and the lever 20 is turned by the spring 21 in the clockwise direction, and the lower end point 20*d* of the arm 20*c* of the lever 20 enters the rotation orbit of the engaging portion 38*j* of the stopping member 38, and the end point 20*d* is ready for engaging only the engaging portion 38*j* by rotation of the sewing machine. In such a state, when the foot plate 101 of the controller 100 is depressed, the belt wheel 5 is rotated, and then the main shaft 1 is rotated via the roller 7, and the stopping member 38 is rotated via the sprocket 29, spring 32, clutch member 8 and spring 35. As the stopper member 38 is rotated, the engaging portion 38*j* of the stopper member 38 is engaged by the end 20*d* of the doubled armed lever 20 as shown in FIG. 11, and the stopping member 38 is stopped. Therefore, the clutch member 8 operates in the same manner as in the case of the intermittent stitching, and disconnects the bushing 3 from the belt wheel 5. The belt wheel 5 above continues to rotate and drive the rubber wheel 24*b*. Therefore thread is wound on a bobbin mounted on the spool pin 24*a* of the thread winding device 24. On the other hand, when the stopping member 38 is stipped, the sewing machine is stopped softly via the buffer members 37 and 37' in the same way as in the case for intermittent stitching.

Here the difference is that since the cam lobe 41*p* of the ring 41 is not engaged by the end 20*d* of the double armed lever 20, the stopper releasing ring 41 is pulled by the spring 39, and the relation between the ring 41 and the stopping member 38 is that as shown in FIG. 7 in which end 36*b* of the pawl 36 on the clutch member 8 is positioned for engaging the stepped part 41*i* of the ring 41. However as the clutch member 8 is rotated due to the inertia against the spring 35 relative to the stopping member 38, the end 36*a* of the pawl 36 rides on the slanted face 38*m* of the cutout 38*g* of the stopping member 38 as shown in FIG. 11, and the end 36*b* of the pawl 36 is displaced from the position for engaging the stepped part 41*i* of the ring 41. Therefore an undesirable sudden stop of the sewing machine is avoided, which may otherwise be caused by engagement of the end 41*e* of the arcuated flange 41*d* of the ring 41 with the end 38*d* of the segment 38*b* of the stopper member. In this instance, as in the case of intermittent stitching, the sewing machine is softly stopped due to the buffer action effected by the contact of the buffer member 37 on the clutch member 8 to the end 37 of the segment flange (38*b*). Thereafter, thread winding can be continued, even if the foot pedal 101 of the controller 100 is released on the way, since the belt wheel 5 has been set to rotate relative to the main shaft 1 of the sewing machine. After the thread winding operation, when the rubber wheel 24*b* is disengaged from the serrated flange 5*e* of the belt wheel 5 by manual operation of the spool pin 24*a*, the depending arm 22 turns the double armed lever 20 in the counterclockwise direction against the action of the spring 21 in FIG. 1. As a result, the lower end 20*d* of the lever 20 is brought out of the rotation orbit of the engaging part 38*j* of the stopper member 38, and the sewing machine is set for ordinary continuous stitching as the main shaft 1 is continuously driven as long as the machine controller 100 is depressed.

It will be understood that each of the elements described above, or two or more together, may also find a useful application in other types of machines differing from the types described above.

While the invention has been illustrated and described as embodied in an intermittent drive for a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sewing machine comprising:

a housing;

a needle on said housing displaceable between a down position engaging through a workpiece and an up position disengaged therefrom;

a drive shaft on said housing operatively connected to said needle;

a drive wheel on said shaft rotatable thereon relative to said shaft;

clutch means including a clutch member on said shaft between said shaft and said wheel and having a control element displaceable between an engaged position for rotationally coupling said wheel and said shaft and a disengaged position for free relative rotation of said wheel and said shaft;

drive means connected to said wheel for rotating same and, in said engaged position of said clutch, for vertically reciprocating said needle between said up and down position;

stop means including a stopper member having an engaging part and mounted on said shaft and a stopper on said housing, said stopper being displaceable between an operative position engageable with said engaging part for stopping rotation of said shaft in a predetermined angular position corresponding to said up position and an inoperative position unengageable with such engaging part;

spring means between said clutch member and said stopper member for relative angular movement thereof between a pair of angularly offset positions;

means for displacing said control elements from said engaged to said disengaged position on engagement of said stopper in said operative position with said engaging part of said stopper member, whereby said shaft can be arrested in said predetermined angular position and is substantially simultaneously rotationally uncoupled from said wheel; and means for substantially simultaneously displacing said control element into said engaged position and said stopper into said inoperative position.

2. The sewing machine defined in claim 1 wherein said clutch member has a part and an elastic element mounted on said part, said stopper member being formed with an abutment engageable with said elastic element to stop the rotation of said clutch member on rotation of said clutch member against the action of said spring means, whereby the rotation of said shaft is stopped.

3. The sewing machine defined in claim 2 wherein said stopper member is driven by said driven means via said clutch member and said spring means, said engaging part of said stopper member engaging said stopper in the operative position thereof before said elastic element of said clutch member engages said abutment of said stopper member.

4. The sewing machine defined in claim 1 wherein said means for substantially simultaneously displacing includes a stopper releasing member formed with an engaging part operatively connected to said stopper member, said clutch member having a pivotal pawl engageable with said engaging part of said stopper releasing member on manual rotation of said shaft when said stopper member is engaged with said stopper in the operative position thereof, whereby said stopper releasing member is rotated to displace said stopper into the inoperative position.

5. The sewing machine defined in claim 1; further comprising a thread winding device including an operating arm pivotably shiftable on said housing between an inoperative position and an operative position in which said device winds a thread in cooperation with said drive wheel, and a lever pivotably mounted on said housing and having a first arm and a second arm, said second arm being normally in an inoperative position, said first arm being operatively connected to said operating arm of said device, said first arm being operated by said device in the operative position thereof to shift said second arm from its inoperative position to an operative position in which said second arm blocks the rotation of said stopper member.

6. The machine defined in claim 1 wherein said drive means includes a motor, means operatively connecting said motor to said wheel, and means for varying the motor speed.

7. The machine defined in claim 1, further comprising an operating element connected to said stopper for displacing said stopper between said operative and said inoperative position.

8. The machine defined in claim 1 wherein said clutch includes a bushing rotationally fixed on said shaft at said wheel and a roller displaceable on said bushing between a position engaging both said bushing and said wheel and a position engaging only said bushing, said control element having a cutout receiving said cam roller.

9. The machine defined in claim 1 wherein the means for displacing said control element into said disengaged position includes a cam lobe operatively connected to said control element and operatively engageable with said stopper only in the operative position thereof, said cam lobe being rotatable with said shaft and being relative to the normal direction of rotation of said shaft by said drive means ahead of said engaging part of said stopper member.

10. The machine defined in claim 9 wherein said stopper is a lever pivoted on said housing and having an end engageable with said lobe and with said engaging part of said stopper member.

11. The machine defined in claim 1 wherein said means for simultaneously displacing includes a first cam rotationally carried on said shaft and operatively engageable with said stopper in the operative position thereof to displace same into said inoperative position.

12. The machine defined in claim 11, wherein said means for simultaneously displacing includes at least one pawl engageable in said cam to rotationally arrest same and cam said stopper into said inoperative position.

13. The machine defined in claim 1, further comprising an actuator limitedly rotatable on said shaft and formed with said control element and with said engaging part.

14. The machine defined in claim 13 wherein said means for simultaneously displacing includes a cam carried on said actuator and having a projection engageable with said stopper arm to displace same from said operative into said inoperative position.

15. The machine defined in claim 14 wherein said actuator is formed with at least one arcuate throughgoing hole, said actuator being provided with a screw passing through said hole and with an elastic bumper at one end of said hole resiliently engageable with said screw.

16. The machine defined in claim 1 wherein said clutch means includes a spring normally urging said control element into said engaged position.

17. The machine defined in claim 1, wherein said means for substantially simultaneously displacing includes at least one pawl carried on said wheel and a cam on said shaft having a recess, said pawl having a projection engageable in said recess, said projection being centrifugally displaced out of said recess on rotation of said wheel.

18. The machine defined in claim 17, wherein said cam is limitedly rotatable on said shaft relative to said actuator and has a spring engaged between said cam and said actuator normally urging said cam in a predetermined rotational sense relative to said actuator.

19. A sewing machine comprising:

a housing;

a needle on said housing displaceable between a down position engaging through a workpiece and an up position disengaged therefrom;

a drive shaft on said housing operatively connected to said needle;

a flywheel secured to the drive shaft;

a drive wheel on said shaft rotatable thereon relative to said shaft;

clutch means including a clutch member on said shaft between said shaft and said wheel and having a control element displaceable between an engaged position for rotationally coupling said wheel and said shaft and a disengaged position for free relative rotation of said wheel and said shaft;

drive means connected to said wheel for rotating same and, in said engaged position of said clutch for vertically reciprocating said needle between said up and down position;

stop means including a stopper member having an engaging part and mounted on said shaft and a stopper on said housing, said stopper being displaceable between an operative position engageable with said engaging part for stopping rotation of said shaft in a predetermined angular position corresponding to said up position and an inoperative position unengageable with such engaging part;

spring means between said clutch member and said stopper member for relative angular movement thereof between a pair of angularly offset positions;

means for displacing said control element from said engaged to said disengaged position on engagement of said stopper in said operative position with said engaging part of said stopper member, whereby said shaft can be arrested in said predetermined angular position and is substantially simultaneously rotationally uncoupled from said wheel;

stopper member releasing means operatively connected to said drive wheel and driven thereby for displacing said stopper into said inoperative position when said engaging part of said stopper member engages said stopper in said operative position thereof;

means for displacing said control element of said clutch member into said engaged position when said stopper is displaced into said inoperative position; and safety means on said clutch member cooperating with said stopper member releasing means for displacing said stopper into said inoperative position by manual operation of said flywheel when said engaging part engages said stopper.

20. The machine defined in claim 19, wherein said stopper member releasing means includes a rotary member having a cam lobe.

21. The machine defined in claim 20, wherein said means for displacing said control element includes a spring connected between said clutch member and said shaft and normally biasing said control element into said engaged portion.

22. The machine defined in claim 20, wherein said safety means includes a pawl pivotally mounted on said clutch member and an engaging part on said stopper member releasing means, said pawl being engageable with said engaging part of said stopper member releasing means when said engaging part of said stopper member engages said stopper in said operative position thereof, whereby said stopper member releasing means is operated by manual actuation of said flywheel to displace said stopper into said inoperative position.

23. The machine defined in claim 22, wherein said engaging part of said stopper member releasing means is provided on said rotary member which in turn is connected to said stopper member for relative limited angular movements.

24. The machine defined in claim 20, wherein said cam lobe of said stopper member releasing means is rotatable on said shaft and is ahead of said engaging part of said stopper member relative to the normal rotation direction of said shaft by said drive means, whereby said cam lobe engages said stopper in said operative position thereof and thereafter engages said stopper to displace said control element of said clutch member from said engaged position to said disengaged position and simultaneously to allow said pawl to engage said engaging part of said rotary member.

* * * * *